US007371107B2

(12) United States Patent
Deng

(10) Patent No.: US 7,371,107 B2
(45) Date of Patent: May 13, 2008

(54) ELECTRICAL CONNECTOR

(75) Inventor: Limin Deng, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/391,397

(22) Filed: Mar. 29, 2006

(65) Prior Publication Data

US 2007/0238352 A1 Oct. 11, 2007

(51) Int. Cl.
*H01R 3/00* (2006.01)

(52) U.S. Cl. ..... 439/491

(58) Field of Classification Search ..... 439/491, 439/488, 910, 357, 590
See application file for complete search history.

(56) References Cited

U.S. PATENT DOCUMENTS

| | | | | | |
|---|---|---|---|---|---|
| 1,644,084 | A * | 10/1927 | Reinke | 40/541 |
| 3,410,949 | A * | 11/1968 | Tischler | 174/256 |
| 4,217,022 | A * | 8/1980 | Carre | 439/404 |
| 4,707,564 | A * | 11/1987 | Gonzales | 174/66 |
| 4,820,193 | A * | 4/1989 | Noorily | 439/488 |
| 4,884,050 | A * | 11/1989 | Kozel | 337/264 |
| 4,941,851 | A * | 7/1990 | Hsueh | 439/620.34 |
| 5,051,870 | A * | 9/1991 | Companion | 361/773 |
| 5,207,594 | A * | 5/1993 | Olson | 439/490 |
| 5,346,411 | A * | 9/1994 | Nikkinen | 439/620.26 |
| 5,735,708 | A * | 4/1998 | Arnett et al. | 439/491 |
| 5,984,716 | A * | 11/1999 | Starkey | 439/488 |
| 6,290,533 | B1 * | 9/2001 | Major | 439/490 |
| 6,325,675 | B1 * | 12/2001 | Harmeyer | 439/709 |
| 6,642,452 | B2 * | 11/2003 | Masson | 174/66 |
| 6,718,674 | B2 * | 4/2004 | Caveney et al. | 40/642.02 |
| 6,776,665 | B2 * | 8/2004 | Huang | 439/676 |
| 6,819,045 | B2 * | 11/2004 | Okita et al. | 313/511 |
| 6,836,402 | B1 * | 12/2004 | Huang | 361/601 |
| 2002/0081893 | A1 * | 6/2002 | Koh | 439/491 |
| 2003/0228808 | A1 * | 12/2003 | Nelson et al. | 439/850 |
| 2004/0074751 | A1 * | 4/2004 | Watanabe | 200/310 |
| 2004/0118669 | A1 * | 6/2004 | Mou | 200/310 |

FOREIGN PATENT DOCUMENTS

GB 2232016 A * 11/1990

* cited by examiner

*Primary Examiner*—Tulsidas C. Patel
*Assistant Examiner*—Vladimir Imas
(74) *Attorney, Agent, or Firm*—Rosenberg, Klein & Lee

(57) ABSTRACT

An electrical connector is connected with a circuit board. The electrical connector includes an insulating body and a plurality of pins received in the insulating body. The insulating body is transparent. There is an identification layer on the bottom of the insulating body. The identification layer is visible through the insulating body. Because the identification layer can be seen via the transparent insulating body, the electrical connector can be rapidly and exactly connected onto the circuit board. The assembly efficient is thereby enhanced.

7 Claims, 4 Drawing Sheets

ELECTRICAL CONNECTOR

BACKGROUND OF THE INVENTION

1. Field of the Invention

The present invention relates to an electrical connector. In particular, this invention relates to an electrical connector on a computer circuit board.

2. Description of the Related Art

Because the cost of computer components have become cheap and computer components are now modulated, almost anyone can assemble a computer even though he or she does not have much computer knowledge.

However, during the assembly process, the user usually needs the complex assembly specification to assemble the computer. Specifically, when the circuit board is linked with the peripherals, it takes a lot of time for many users to understand the assembly specifications to prevent the peripherals from being linking to the circuit board with the incorrect connection lines. In fact, in order to reduce assembly time, there is a protection device on the circuit for the important electrical connectors, such as the memory electrical connectors, the bus electrical connectors, the hard disk electrical connectors, and the interface card electrical connectors, etc. Except for the above-mentioned electrical connectors, there exist other electrical connectors for setting the configuration, or connecting to the small devices, such as indicating lamps, or fans. Because the dimension of the electrical connectors is small or the structure of the electrical connectors is simple, there are no protection devices on the electrical connectors. Therefore, when the user assembles a device with an electrical connector, some problems usually occur, such as assembling the device onto the wrong electrical connector, or assembling the device with the wrong polarity. Even though the assembly is executed according to the assembly specifications, problems still may occur.

SUMMARY OF THE INVENTION

One particular aspect of the present invention is to provide an electrical connector that avoids the problem of connecting the electronic elements to the wrong location of the circuit board.

The electrical connector is connected with the circuit board. The electrical connector includes an insulating body and a plurality of pins received in the insulating body. The insulating body is transparent. There is an identification layer on the bottom of the insulating body. The identification layer is visible through the insulating body.

Because the identification layer can be seen via the transparent insulating body, the electrical connector can be rapidly and exactly connected onto the circuit board. The assembly efficient is thereby enhanced.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

The electrical connector of the present invention is illustrated by referring to the attached diagrams and the preferred embodiment.

Figure 1:
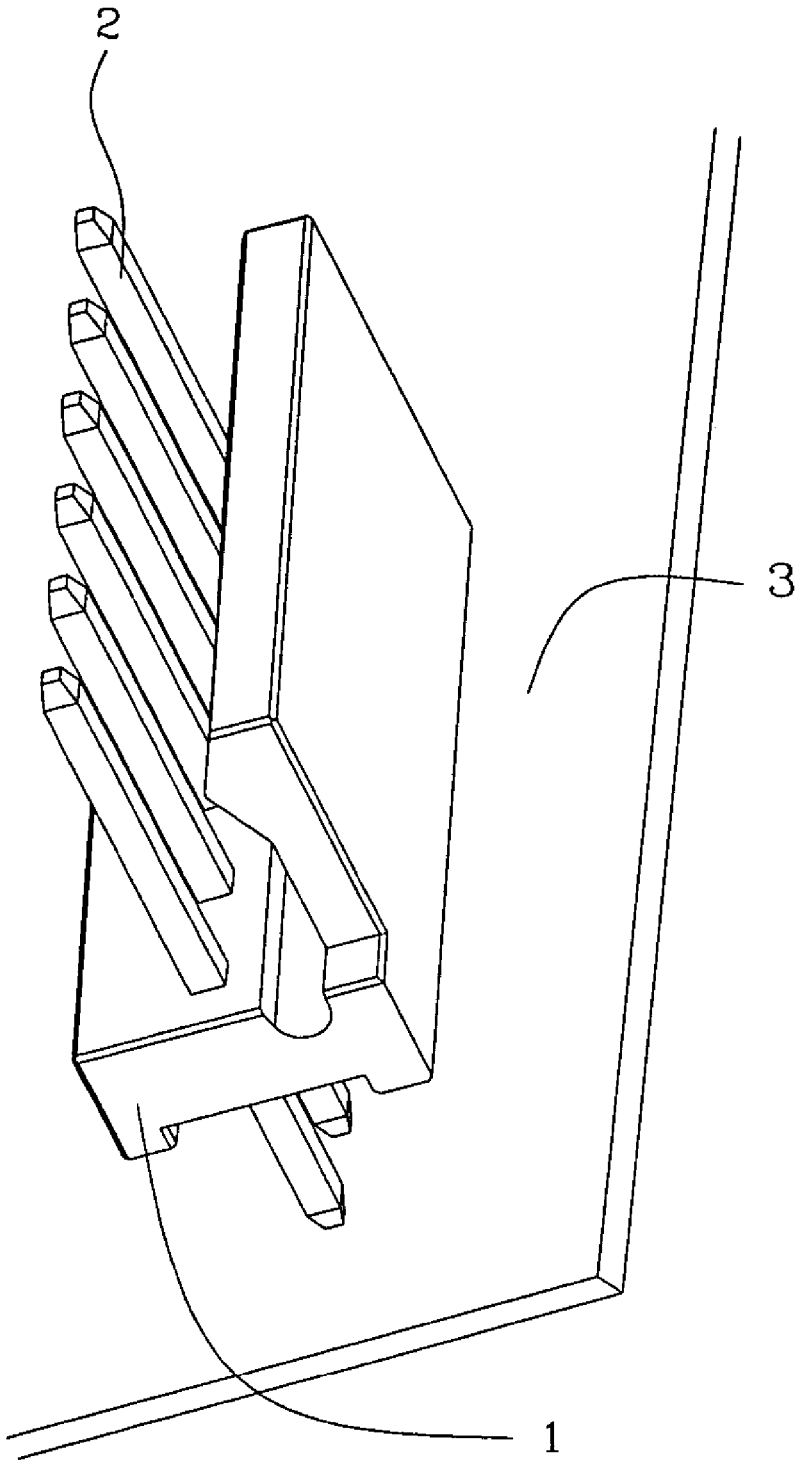
FIG. 1 is perspective view of the electrical connector and the circuit board of the present invention.
Figure 2:
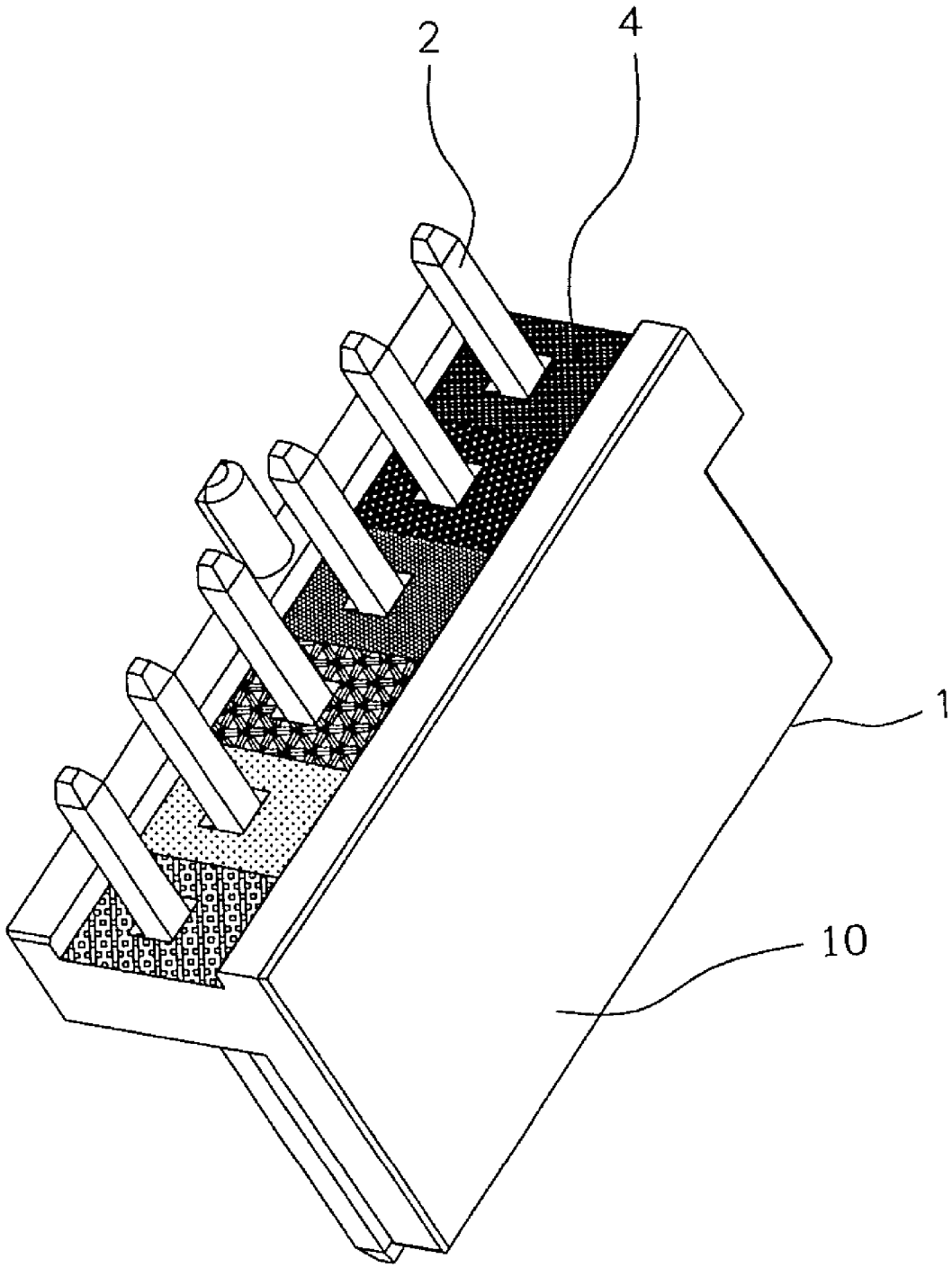
FIG. 2 is a perspective view of the electrical connector of the present invention.
Figure 3:
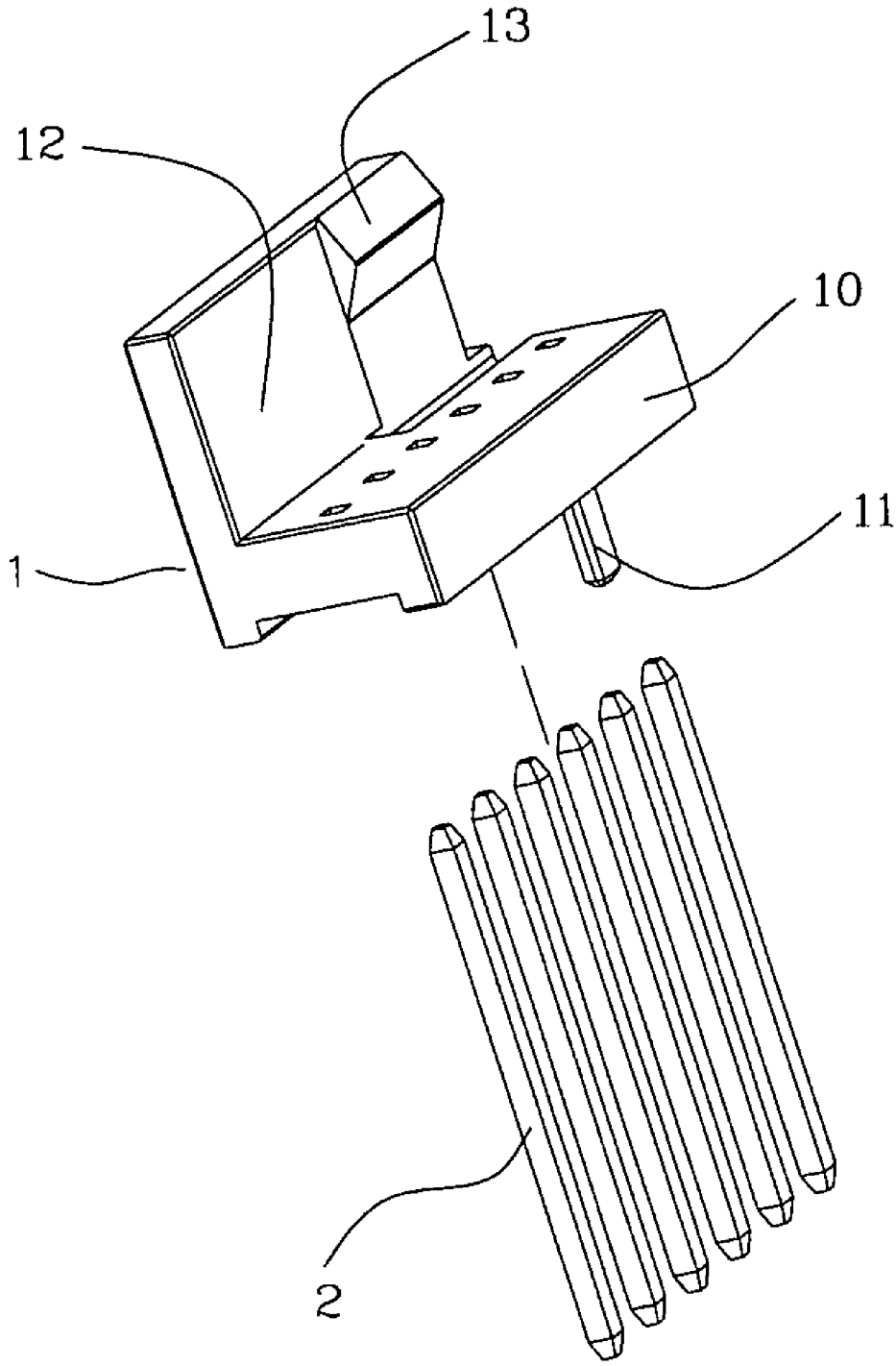
FIG. 3 is an exploded perspective view of the electrical connector of the present invention.

Reference is made to FIGS. 1, 2 and 3. The electrical connector is connected with the circuit board 3. The electrical connector includes an insulating body 1, a plurality of pins 2 received in the insulating body 1, and an identification layer 4 located on the bottom of the insulating body 1.

The insulating body 1 includes a body 10, a positioning column 11 that protrudes downward from the middle location of the lower surface of the body 10 (alternatively, it may be a plurality of positioning columns), and a wedged wall 12 that extends from the upper surface of the body 10. On one end of the wedged wall 12, there is a wedged hook 13 that protrudes forward to the inner of the body 10 for fastening the electronic element (not show in the figure).

The identification layer 4 is printed on the bottom of the body 10 (alternatively, the identification layer 4 is pasted on the bottom of the body 10). The shape of the identification layer 4 is almost the same as the shape of the lower surface of the insulating body 1. The identification layer 4 includes a plurality of labels (at least two labels). Part of the pins correspond to the specified labels. The labels are arranged by a specified method to match the electrical element. Therefore, the problem of improperly assembling the electronic element with the electrical connector is avoided. The labels are identified according to patterns (alternatively, the identification labels are identified according to colors, patterns and colors, or text).

Because the insulating body 1 is transparent, the identification layer 4 printed on the bottom of the insulating body 1 is visible through the insulating body during the assembling process. Therefore, the electronic element can be rapidly assembled to the circuit board according to the patterns of the identification layer 4 and the problem of improperly assembling the electronic element with the electrical connector is avoided.

Figure 4:
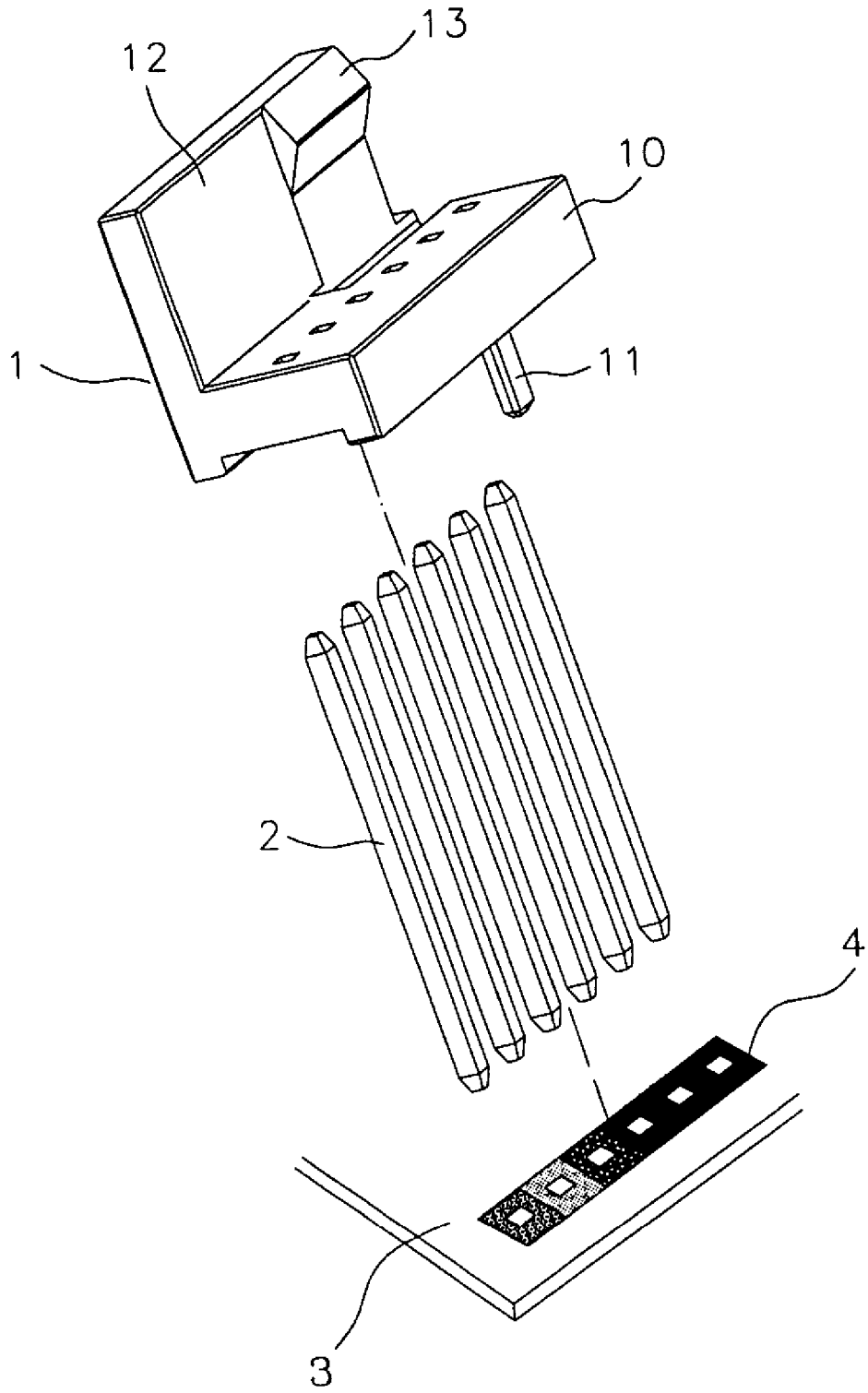
FIG. 4 is a perspective view of the second embodiment of the electrical connector of the present invention.

Reference is made to FIG. 4, which shows another embodiment of the present invention. The difference between the second embodiment and the first embodiment is the identification layer 4 is printed on the location of the circuit board 3 where the insulating body 1 is installed (alternatively, the identification layer 4 is pasted on the circuit board 3). Therefore, the electronic element can be rapidly assembled to the circuit board according to the patterns of the identification layer 4 and the problem of improperly assembling the electronic element with the electrical connector is avoided.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An electrical connector,connected with a circuit board, comprising:

a transparent insulating body;

a plurality of pins extending from an underside of the insulating body; and an identification layer having indicia disposed on the underside of the insulating body, said indicia corresponding to at least one of said plurality of pins and thereby to an electrical element coupled to the electrical connector, wherein each of the pins and the identification layer are simultaneously visible through the transparent insulating body.

2. The electrical connector as claimed in claim 1, wherein the indicia includes at least two labels.

3. The electrical connector as claimed in claim 2, wherein the labels are identified according to colors, patterns, or both patterns and colors.

4. The electrical connector as claimed in claim 2, wherein the labels are identified according to text.

5. The electrical connector as claimed in claim 1, wherein the identification layer is located on a bottom surface of the insulating body.

6. The electrical connector as claimed in claim 5, wherein the identification layer is printed or pasted on the bottom surface of the insulating body.

7. The electrical connector as claimed in claim 1, wherein at least one positioning column protrudes downward from a lower surface of the insulating body.

* * * * *